US011688978B2

(12) United States Patent
Leibig et al.

(10) Patent No.: US 11,688,978 B2
(45) Date of Patent: Jun. 27, 2023

(54) SURFACE-MOUNTABLE THERMOCOUPLE CONNECTOR WITH REVERSE POLARITY PROTECTION

(71) Applicant: Omega Engineering, Inc., Norwalk, CT (US)

(72) Inventors: Kenneth J. Leibig, Coatesville, PA (US); Matthew Annen, Malvern, PA (US)

(73) Assignee: Omega Engineering, Inc., Norwalk, CT (US)

( * ) Notice: Subject to any disclaimer, the term of this patent is extended or adjusted under 35 U.S.C. 154(b) by 571 days.

(21) Appl. No.: 16/703,476

(22) Filed: Dec. 4, 2019

(65) Prior Publication Data

US 2021/0091510 A1 Mar. 25, 2021

Related U.S. Application Data

(60) Provisional application No. 62/905,866, filed on Sep. 25, 2019.

(51) Int. Cl.
*H01R 13/642* (2006.01)
*H01R 13/03* (2006.01)
(Continued)

(52) U.S. Cl.
CPC ..... *H01R 13/642* (2013.01); *H01R 12/57* (2013.01); *H01R 13/03* (2013.01); *H01R 13/10* (2013.01); *H01R 43/205* (2013.01)

(58) Field of Classification Search
CPC ..... H01R 12/57; H01R 13/03; H01R 13/10; H01R 13/112; H01R 13/642; H01R 43/205
See application file for complete search history.

(56) References Cited

U.S. PATENT DOCUMENTS 4,813,881 A * 3/1989 Kirby ..... H01R 13/111 439/654
10,044,126 B2 * 8/2018 Krebs ..... H01M 50/514
(Continued)

FOREIGN PATENT DOCUMENTS

KR 1020170034693 A 3/2017

OTHER PUBLICATIONS

ISR WO2021061174-ISR-202110401-3319 International search report.

*Primary Examiner* — Minh N Trinh
(74) *Attorney, Agent, or Firm* — Dennemeyer & Associates, LLC

(57) ABSTRACT

A connector to easily and correctly join an electrical component to a printed circuit board is provided. The connector comprises a generally C-shaped electrically conductive element that provides for connection alternatively to the positive and negative terminals of a device depending on the orientation of the connector. As a result of the shapes of the ends of the connector, a device can only be plugged in one way. The connector can be made from a single sheet of electrically conductive material bent generally into a "C" shape, with specific tabs and cuts made therein. The connector includes a tab that allows for quick and automated connection to a printed circuit board, and an element to prevent connectors from interlocking while in a loose and unconnected state as, during manufacturing, plating, or storage, allowing them to be added to a board using automated procedures for quick, accurate and low cost construction.

7 Claims, 4 Drawing Sheets

(51) Int. Cl.

| | |
|---|---|
| ***H01R 12/57*** | (2011.01) |
| ***H01R 43/20*** | (2006.01) |
| ***H01R 13/10*** | (2006.01) |

(56) References Cited

U.S. PATENT DOCUMENTS

| | | | | |
|---|---|---|---|---|
| 2012/0122325 | A1 | 5/2012 | Lin et al. | |
| 2017/0142857 | A1 | 5/2017 | Linderman et al. | |
| 2017/0310050 | A1 | 10/2017 | Lampert et al. | |
| 2018/0087749 | A1 | 3/2018 | Chen | |
| 2021/0091510 | A1* | 3/2021 | Leibig | H01R 13/03 |

* cited by examiner

SURFACE-MOUNTABLE THERMOCOUPLE CONNECTOR WITH REVERSE POLARITY PROTECTION

FIELD OF THE INVENTION

The present invention concerns thermocouple connectors for use on printed circuit boards. More particularly the present invention concerns connectors that are low profile, to fit in tight spaces, reversible as positive/negative connectors in one design, pick and place machine mountable on printed circuit boards and provide reverse polarity protection via a connection that is an error proof (poka-yoke) design that can only be used in one direction such that a device, to be connected to the circuit board, can only be plugged into the circuit board in correct alignment.

BACKGROUND OF THE INVENTION

Printed circuit boards having the need of connection to external controls or devices are known and in common use. The means to attach external controls or devices have typically included connectors wherein an opening must be made in the board and the connector hard soldered into place. Such means of connection, therefore, have required additional time to do one-off attachment and have produced questionable results, damage to circuit boards due to the soldering process and considerable delays in production due to the need for precise work and the use of skilled workers in such connections. Additionally, the connectors of the prior art are typically identical elements that allow connection of devices in such a manner that the device can be plugged in without concern for correct polarity and if plugged in an incorrect manner can cause damage to the device and to the circuit board.

The primary art to consider in this area are products like Omega's PCC-SMP, which are female thermocouple connectors that connect a male thermocouple connector to a printed circuit board. This is available in both miniature (PCC-SMP) and standard (PCC-OST) sizes and offered by many different vendors. The inadequacy associated with these types of legacy connectors is that they are through-hole technology and therefore require the user to hand-solder them to the printed circuit board (that is, these products do not use surface mount technology). In high-volume applications, this becomes very expensive manual labor or requires expensive automation equipment. An additional inadequacy with this type of product is that it is not well thermally coupled to the PCB, so you need to use a remote temperature sensor to achieve adequate cold junction compensation (for example, see Omega Engineering, Inc. model: PCC-SMP-*-R). This remote temperature sensor results in additional cost and is quite difficult (and expensive) to populate. In many applications, this remote temperature sensor does not provide adequate cold junction compensation. The last mentionable inadequacy of this design is that it could not be used with 3-wire Resistance Temperature Detectors (RTDs).

Improvement of such connectors and the process of connection have been shown in the previously available PAX Instruments Surface Mount Thermocouple (SMT) Contacts. This was an open source invention on Github, where a Mr. Charles Pax and some online followers designed this SMT thermocouple connector. The improved feature of this art was that the connector was now SMT mountable with standard pick-and-place machines/PCB automation. It appears that the reason for this design was to support the development of PAX Instruments' T400 Thermocouple data logger, but PAX also decided to sell the SMT thermocouple connectors separately. PAX appears to have gone out of business in 2017 as they stopped accepting orders, shipping product, and responding to customer inquiries. Therefore, their SMT Thermocouple Connector is no longer available. Additionally, it has been found that the PAX device is inadequate in that there is no reverse polarity incorporated into the design, such that the user could plug the thermocouple in backwards, potentially damaging both the equipment attached and the printed circuit board. The PAX design has also been found to be quite complex with many bends, causing it to be difficult and expensive to manufacture. Finally, because the design encompasses several complex bends, it is possible for the user to plug the mating thermocouple connector into the wrong open "slots", which would result, while correct in polarity, in an insecure connection.

It is therefore an object of the present invention to provide a means for more simply attaching connectors to a circuit board to provide secure and nominal connections for devices such as thermocouples; to make such connectors with fewer undulations so that connections are more secure, less material is used, the connectors are easier to fit and can be rotated for positive/negative connection using the same design and so that a device to be connected therewith, can only be connected in one direction for ease of connection and the protection of the device and printed circuit board. Additionally, it would be desirable for the device to be a single unit creating a connector that provides a different opening at each end, such that with one connector design positive and negative terminals can be plugged into different ends—by placing two connectors parallel to each other in reverse orientation a connection is created that provides access to the circuit board in correct polarity; thereby saving effort time and money in creating one device each for negative and positive terminals. By such design, then any number of devices can be placed, side by side, in the orientation needed, to create sockets for two, three and/or more wire systems.

Other objects and advantages of the present invention will become apparent as the description proceeds.

SUMMARY OF THE INVENTION

In accordance with the present invention, a connector element comprising a single sheet of electrical conductive material folded to form a generally tubulated element is provided. The generally tubulated element has an elongated axis having a first and second end each formed such that the first end can fit a positive electrical connector and the second end can fit a negative electrical connector; the connector having a tab to allow for the quick attachment and easy alignment of the generally tubulated element to a printed circuit board. In a preferred embodiment, the connector element is made of beryllium-copper and is plated with nickel and is created from a single sheet of electrically conductive material folded into a generally "C"-shaped form.

When an electronic connection is desired two of these electrical connectors are placed in a generally parallel relationship, in reverse axis configuration, to form a junction socket for an electrical device. With the noted tab, the placement of the connectors forms a poka-yoke connection for polarity protection. In preferred embodiments, the connector includes an alignment tab, depending generally perpendicular from the bottom of the connector element, for aiding in affixing the connector element to a printed circuit board. Additionally, the connector includes a tab, projecting out from the top of the connector element, generally perpendicular to the elongated axis, to prevent two or more connection elements from inter-tangling with each other.

In the use of the device of the present invention, a method of providing connection for an electrical device to a printed circuit board includes the steps of forming a pair of generally tubulated elements from electrically conductive material, the generally tubulated elements each having a long axis the ends of the generally tubulated elements being formed such that at one end of each of the axes the generally tubulated element is formed to fit a positive prong of a plug and at the other end of each of the axes the generally tubulated element is formed to fit a negative prong of a plug. Then attaching and electrically linking each of the tubulated elements, in generally parallel configuration and reverse polarity, to the printed circuit board to form a socket connector. In this manner, once so configured, an electrical device can be plugged into one end of each of the generally tubulated elements and be in electrical connection with the printed circuit board.

The devices used in this method are preferably electrically conductive, and are made of a sheet of such material as beryllium-copper plated with nickel. These devices are simply made by folding the sheet of material into a generally "C"-shaped form. In some instances, where a device has more than two prongs, three or more of the devices can be used to accommodate the plug element.

In order to more easily attach such devices to printed circuit boards, the method of using the devices includes the inclusion of a tab for aid in connection within a printed circuit board and can include a second tab, projecting out from the connector element in a generally perpendicular to the elongated axis position, to prevent two or more connection elements from inter-tangling with each other.

A more detailed explanation of the invention is provided in the following description and claims and is illustrated in the accompanying drawings.

DETAILED DESCRIPTION OF THE ILLUSTRATIVE EMBODIMENT

Figure 1:
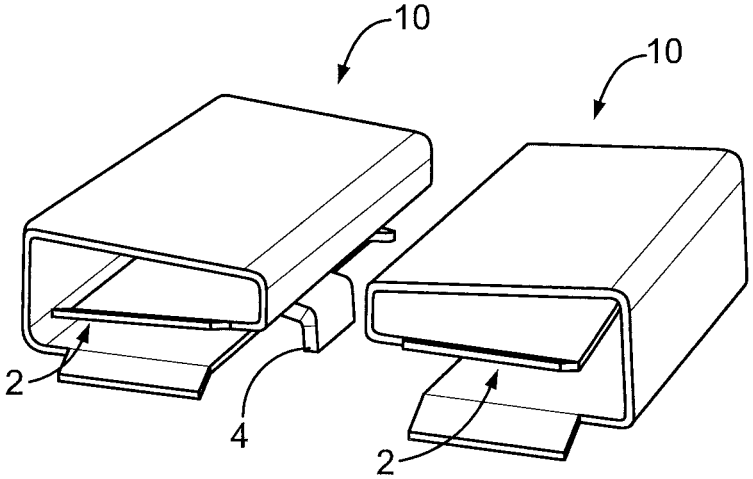
FIG. 1 PRIOR ART
FIG. 1 is a perspective view of a connector of the prior art.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Figure 2:
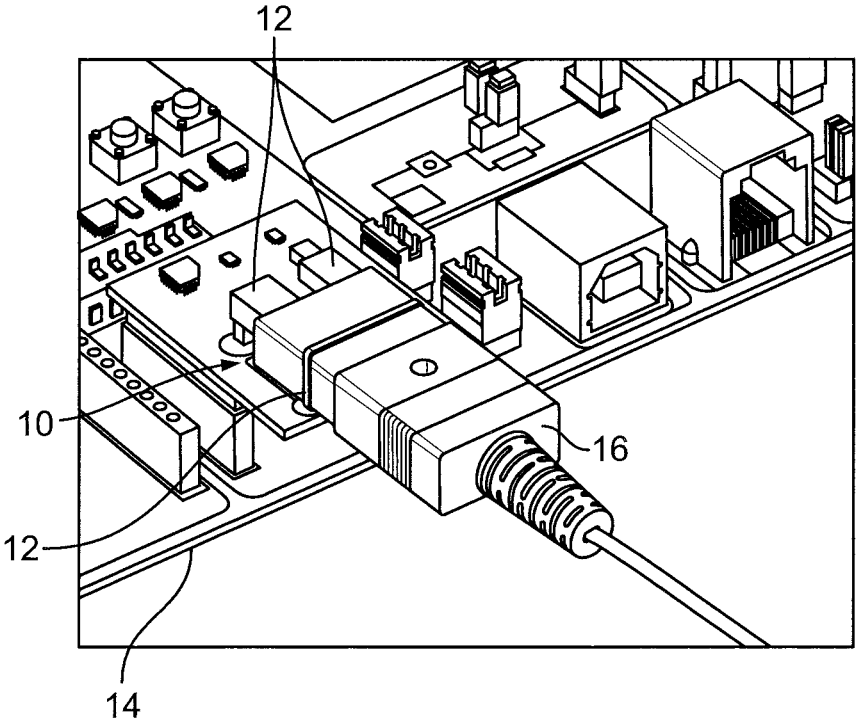
FIG. 2 PRIOR ART
FIG. 2 is a perspective view of a second connector of the prior art in place on a circuit board.
Figure 3:
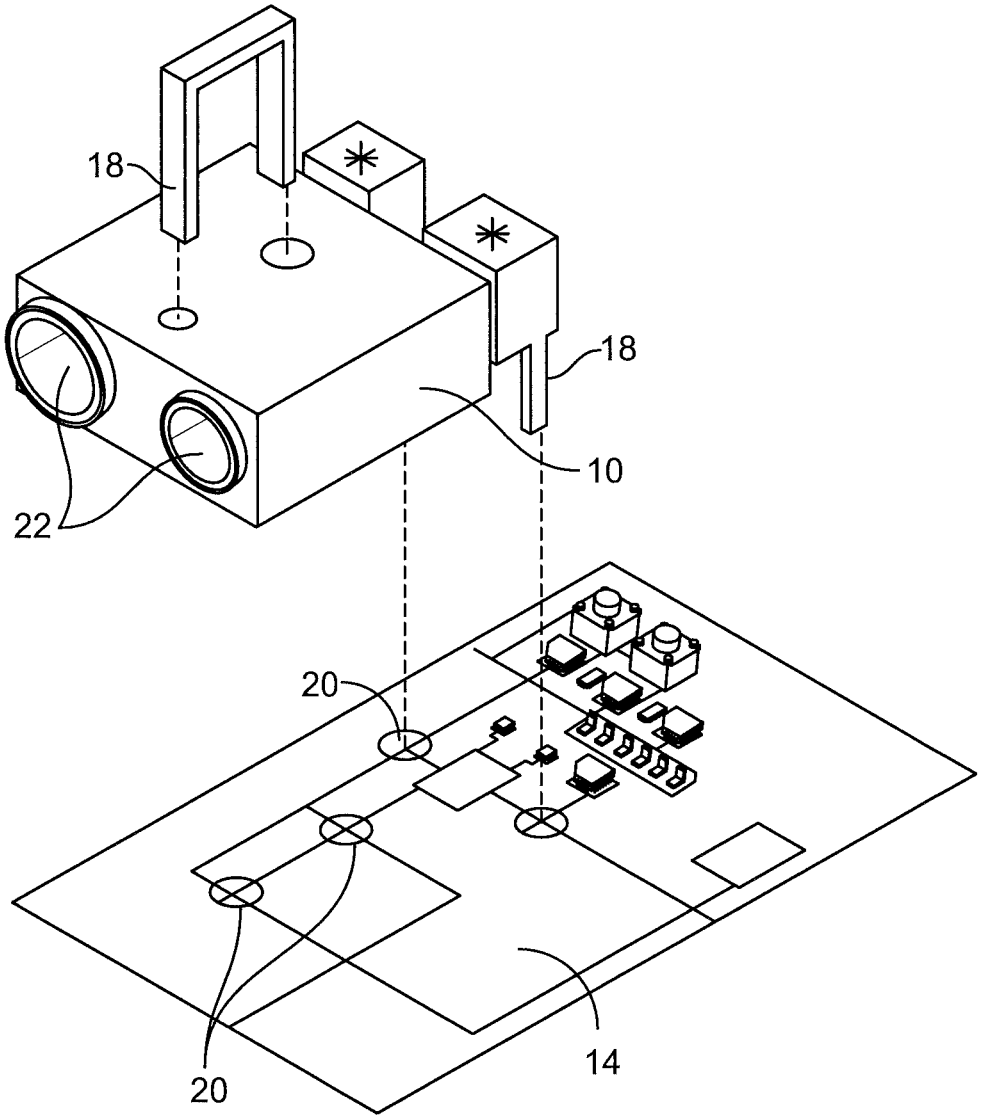
FIG. 3 PRIOR ART
FIG. 3 is an exploded perspective view of a connector of the prior art being placed on a circuit board.

Referring to the drawing figures, a connector of the prior art is shown in a perspective view in FIGS. 1 and 2. It will be seen that devices 10 in FIG. 1 comprises folded material having electronic conductivity and means to connect to a printed circuit board and form a connection therewith with an outside device, such as a thermocouple, which when connected will form a device that can be used to measure such things as temperature of third products by taking the measurement of temperature and providing information to the circuit board, for discernment by the devices making up the circuit board. The devices 10 in FIG. 1 are identical Pax connectors shown in reverse configuration next to each other, so that it can be seen that the opening 2 of each connector are identical and by design can incorporate any sized prong, either different widths or identical widths, in either sides opening, leading to, at times, incorrect polarity with the device there plugged. The Pax device 10 includes tabs 4 that allow the device to be placed on a circuit board. The device 10 of FIG. 2 comprises metal elements 12, attached to a printed circuit board 14 allowing the flow of electrons from a male thermocouple connector. 16 to the circuit board 14 for measurement by elements making up the circuit board 14 and for display on any type of display device. The device 10, as shown in FIG. 3, is a more complex connector still in use that comprises elongated connector elements 18 that are pushed through opening 20, in circuit board 14, so that the device 10 can be attached, to the circuit board 14, typically by soldering. It will be understood by persons having ordinary skill in the art that such connection, in the prior art, is made by making openings in the board, pushing the device into the board and hand soldering the device onto the board and into electronic communication with the board. Such processes take an extraordinary amount of time and the use of skilled workers to create a proper and long lasting connection on a circuit board. Connector 10 is a complex element that further includes openings 22 into which an external instrument, such as a thermocouple, can be plugged into. It will be seen that openings 22 are differentiated by size so that a plug can only be plugged in one way.

Figure 4:
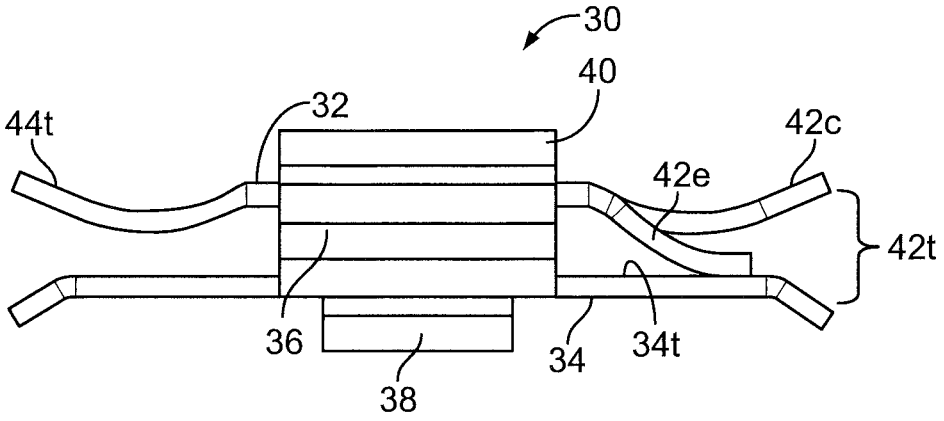
FIG. 4 is an elevational view of a connector of the present invention.
Figure 5:
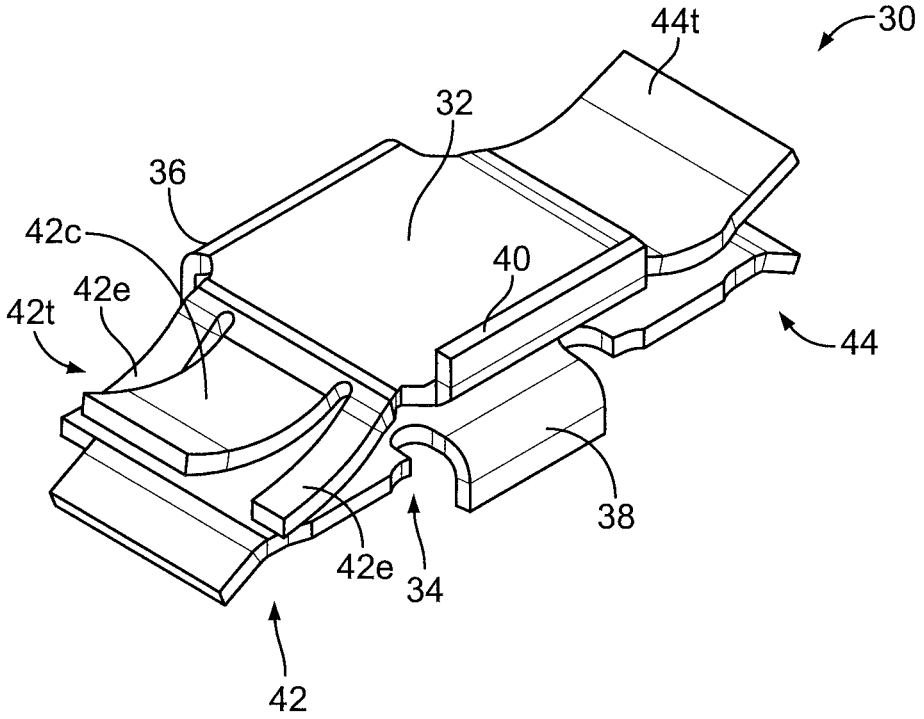
FIG. 5 is a perspective view of a connector of the present invention.

Referring now to FIGS. 4 and 5, two views of the device 30 of the present invention are shown. FIG. 4 shows the device 30 in an elevational view. In a preferred embodiment, device 30 is created from a single sheet of electrically conductive material; in the preferred embodiment the material is an amalgam of beryllium and copper that is nickel plated—which allows excellent conductivity, allows the bending and forming of the desired shape and is resistant to corrosion. It will be understood that numerous other materials, amalgamations, alloys and other material types, can be substituted herein without departing from the novel scope of the present invention. In FIG. 5, a perspective view of device 30, it can be more clearly seen that the final product of the bending of the sheet of electrically conductive material is a generally C-shaped element, having a top wall 32, a bottom wall 34 and a sidewall 36, generally forming a C-shape. Depending from bottom wall 34, and extending generally perpendicular thereto, is a connection tab 38, which is used to fix the position of device 30 on a printed circuit board, for a pick and place automated installation, in a manner known to persons having ordinary skill in the art. Disposed from top wall 32, and extending generally perpendicular thereto, is a larger tab 40, which is provided to keep device 30 free from entanglement with other devices 30.

The device 30, as illustrated in FIG. 5, clearly shows that, when viewed in the direction of the figure, the left side 42 and right side 44 of device 30 are created with different top members 42*t* and 44*t*. It will be seen, that top member 42*t* comprises a central curved section 42*c* depending from top 32 and two end members 42*e* that also depend from top 32 but are angled more severely (and, as shown in FIG. 4, are made to touch the top 34*t* of bottom wall 34). Top member 44*t*, in contrast, is a one-piece element, curved similarly to the central curved section 42*c*. Each device 30 is made in this way to provide, in one element, a connector for both a positive and a negative terminal of an electronic instrument, as will be described in more detail below. Because of the differences in top members 42*t* and 44*t*, when assembled correctly in pairs (or other configurations, including the use of three connectors in a three-wire system) the one device 30 can accommodate differing prongs of the electronic element, in the manner that the prior art device 10 (in FIG. 3) does with elements 22.

Figure 6:
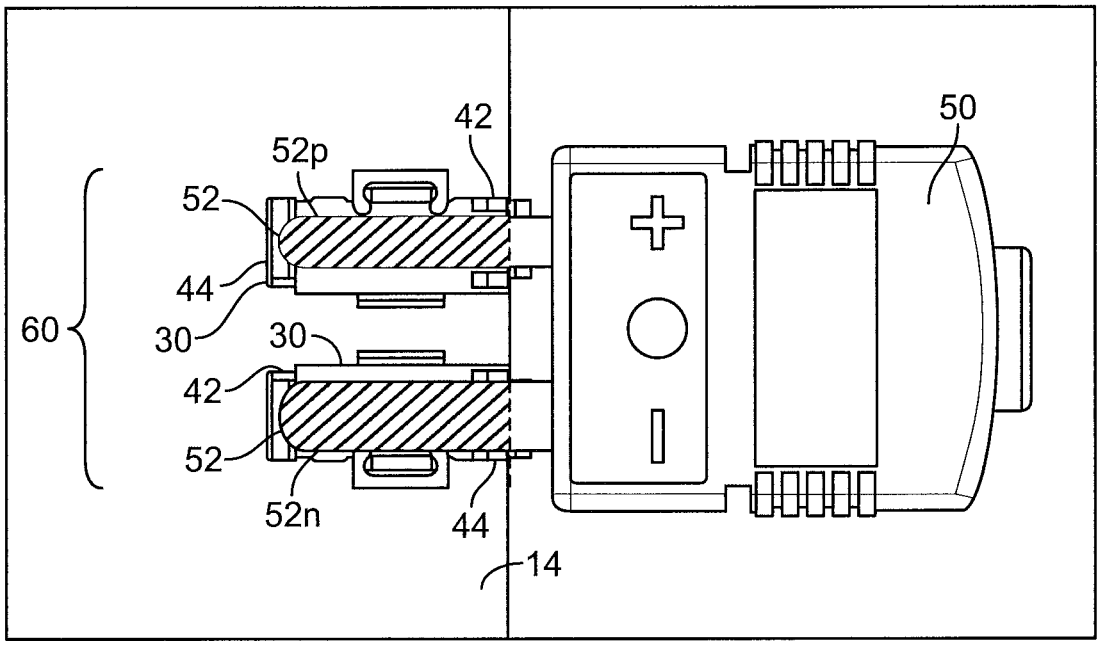
FIG. 6 is a plan view of connectors of the present invention, partially cut away to show placement of a device therein, in place on a printed circuit board and connected to an external device.
Figure 7:
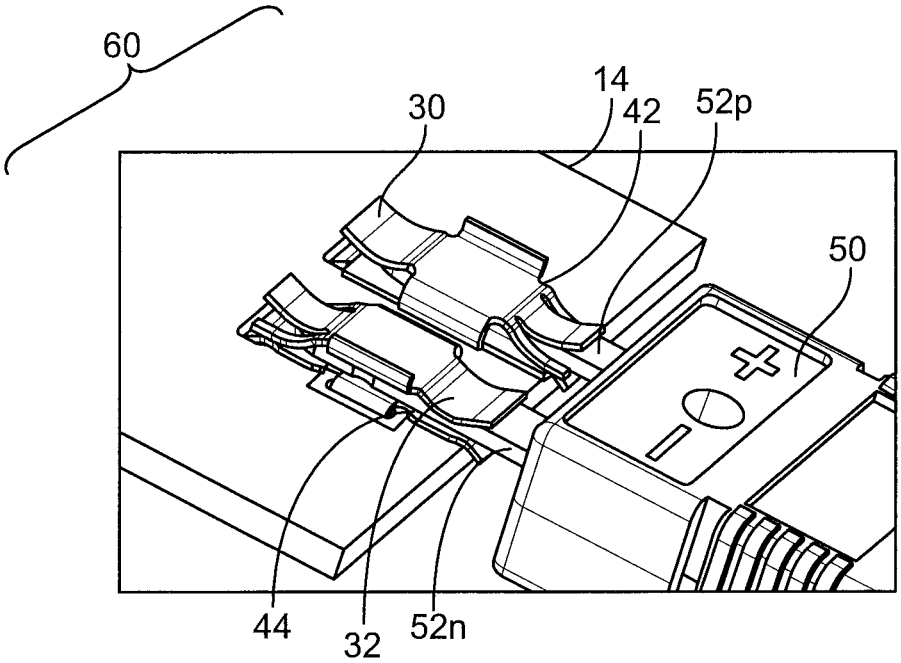
FIG. 7 is a perspective view of the connectors of the present invention in place on a printed circuit board and connected to an external device.

Referring now to FIGS. 6 and 7, there is shown the use of devices 30 in combination on a circuit board 14. FIG. 6 shows an electronic element 50 in place within devices 30; so as to more clearly demonstrate the shape and sizes of connective prongs 52, in relation to devices 30, devices 30 are shown partially cut away (please compare same structures in FIG. 7) so that the relative sizes of the prongs 52 can be better shown relative thereto. It will be seen in FIG. 6, that negative prong 52*n* has a greater width than positive prong 52*p* has; which is a standard configuration of negative and positive prongs on such elements. In this manner, the user of the devices 30 can only plug electronic elements 50 into circuit boards 14, which have the devices of the present invention thereon, one way (that is, turning element 50 upside down and trying to plug prongs 52*n*, 52*p* into devices 30, will not work due to the sizes of the prongs and the concomitant sizes of the openings in devices 30); this is to protect the element 50 and the board 14 from the deleterious effects of accidently reversing the polarity of either. As is demonstrated in FIG. 6, when viewed with FIG. 5, the larger width prong 52*n* can only fit into the right side element 44 that has the large opening therein and the more narrow width prong 52*p*, which could be placed in either side, is more well suited to be placed into the left side element 42, which has leg elements 42*e* to help create a snug fit within device 30 for prong 52*p* and create a barrier to the incorrect introduction of wide prong 52*n* therein. In this way, a connector made of two devices 30 in a reverse orientation to each other, forms a socket 60 for the plug element of element 50. It will be understood that with one element, device 30, any configuration of plug can be formed with the correct number of individual devices 30 oriented alongside each other as needed to accommodate the number of prongs from the device. It will be understood by persons having ordinary skill in the art that the device of the present invention covers all SMT mountable Thermocouple connectors that incorporate an asymmetrical design to ensure reverse polarity protection. It should also be understood, that the device is not exclusive to thermocouples but can be used for all electrical based temperature sensors, including RTDs and Thermistors, as well.

FIG. 7 shows the connection of the electronic element 50 with the socket 60 of the present invention. Prong 52*p* is clearly shown fitting into side 42, with prong 52*p* held tightly, and in electrical communication, therein by end members 42*e* and prong 52*n* is shown held within the top 44*t* and bottom 34 of end 44, in electronic communication; all to form an electrical circuit connecting element 50 to circuit board 14. Each device 30 is shown in place in reverse orientation from the other device 30, which form socket 60, so as to show that with a single style of element 30, thereby simplifying the process of making such devices in that only one design is needed to accomplish the designated purpose, is used to create the attachment point for a circuit board.

Because only one type of device 30 is needed, manufacturing is simplified and the process of creating printed circuit boards using such elements is simplified and accelerated. Fewer errors are made and better boards are produced in a more completely automated manner, thereby increasing production ability as well as providing cleaner and less buggy operations.

In specific summary then, the invention is a Surface Mountable Thermocouple Connector with reverse polarity protection (PCC-SMD). Though the primary application is for Thermocouple sensors, it is not exclusive to thermocouples. The design of the invention can be used for all electrical based temperature sensors, including Resistance Temperature Detectors (RTDs) and Thermistors. Similar to the prior and no longer available PAX art, this Thermocouple Connector is a Surface Mountable Device, meaning it is automation-ready for standard pick-and-place machines/PCB automation. This SMD style thermocouple connector will save the PCB manufacturer labor and cost, making it very attractive for high-volume applications. The present invention has at least three primary improvements over existing connectors, among these are:

1) The present invention provides reverse polarity protection, making it "error-proof" (poka-yoke). The PCC-SMD is designed with specific features with mechanical blocking so that the user is not able to plug the mating Thermocouple connector in backwards or upside down. This device of the invention is asymmetric and ensures that the PCB manufacturer must mount the connector in the fashion that the PCB designer intended.

2) A secondary improvement is that the device of the present invention can be made much slimmer in height than prior existing devices. The existing device disclosed above is 3.27 mm in height, whereas the device of the present invention is, in a preferred embodiment, 2.36 mm at its maximum point (a 28% reduction in height, with the same footprint). This is notable because this allows for thinner electronics and tighter PCB packing within casing, which is important in the advancing electronics industry.

3) A tertiary improvement is that the present invention incorporates only 2 primary bends, resulting in simple "c" shaped geometry, whereas the existing device disclosed above has 4 primary bends, resulting in "e" shape geometry. The existing device, therefore, requires 55% more raw material, as well as much more complex tooling to be made. This results in the device of the present invention being much more easily manufacturable and also more economical to make.

Although an illustrative embodiment of the invention has been shown and described, it is to be understood that various modifications and substitutions may be made by those skilled in the art without departing from the novel spirit and scope of the invention.

What is claimed is:

1. A connector element for connecting to a printed circuit board, so as to enable the connection of a separate electric device to the circuit board, the connector element comprising:

one piece element of a single sheet of electrical conductive material formed so as to have an elongated axis and have a first end, a second end and a central section therebetween, the central section comprising a tubulated element have a generally C-shaped cross section, the first end being configured to insert, in electronic connectivity, only a positive electrical prong therein and the second end being configured to insert, in electronic connectivity, a negative electrical prong therein;

the tubulated element of the center section further includes a tab extending generally perpendicular to a bottom wall and other tab extending from a top wall adapted for creating a quick attachment guide for electronically and physically attaching a surface mountable (SMT) temperature sensor connector element to a printed circuit board with either the first end or the second end, as desired, in a prong insertion direction.

2. The connector element of claim 1, wherein the one piece element of the single sheet of electrical conductive material is made of beryllium-copper and is plated with nickel.

3. The connector element of claim 1, wherein the one piece element of the single sheet of electrically conductive material is folded into a generally C-shaped form.

4. The connector element of claim 1, wherein the one piece element further comprises two electrical connectors placed in a generally parallel relationship, in a reverse axis configuration, to form a junction socket for an electrical device.

5. The connector element of claim 4, where the placement of the two connector forms a poka-yoke connection for polarity protection.

6. The connector element of claim 4, wherein the two electrical connectors are in a poka-yoke relationship, for reverse polarity protection, and are in electrical connection with the printed circuit board, such that the negative prong of a plug cannot be inserted into the positive end of the tubulated element.

7. The connector element of claim 1, wherein the one-piece element further comprises the other tab, projecting out from the top of the tubulated element, generally perpendicular to the elongated axis, to prevent two or more tubulated elements from inter-tangling with each other.

* * * * *